United States Patent [19]

Gilman et al.

[11] Patent Number: 4,898,612

[45] Date of Patent: Feb. 6, 1990

[54] FRICTION-ACTUATED EXTRUSION OF RAPIDLY SOLIDIFIED HIGH TEMPERATURE AL-BASE ALLOYS AND PRODUCT

[75] Inventors: Paul S. Gilman, Suffern, N.Y.; Michael S. Zedalis, Randolph, N.J.

[73] Assignee: Allied-Signal Inc., Morris Township, Morris County, N.J.

[21] Appl. No.: 238,790

[22] Filed: Aug. 31, 1988

[51] Int. Cl.[4] ..... B22F 1/00

[52] U.S. Cl. ..... 75/249; 419/33; 419/41; 419/67

[58] Field of Search ..... 419/33, 41, 67; 75/249

[56] References Cited

U.S. PATENT DOCUMENTS

| | | | |
|---|---|---|---|
| 4,347,076 | 8/1982 | Ray et al. | 75/249 |
| 4,675,157 | 6/1987 | Das et al. | 75/249 |
| 4,729,790 | 3/1988 | Skinner | 75/249 |
| 4,765,954 | 8/1988 | Das et al. | 419/23 |

*Primary Examiner*—Stephen J. Lechert, Jr.

*Attorney, Agent, or Firm*—Ernest D. Buff; Gerhard H. Fuchs

[57] ABSTRACT

A friction-actuated extrusion process utilizes a comminuted rapidly solidified aluminum alloy ribbon as the in-feed for a continuous friction-actuated extruder. Gumming and flow problems are eliminated. The resulting product is devoid of surface blistering and has improved ambient and elevated temperature mechanical properties.

14 Claims, 1 Drawing Sheet

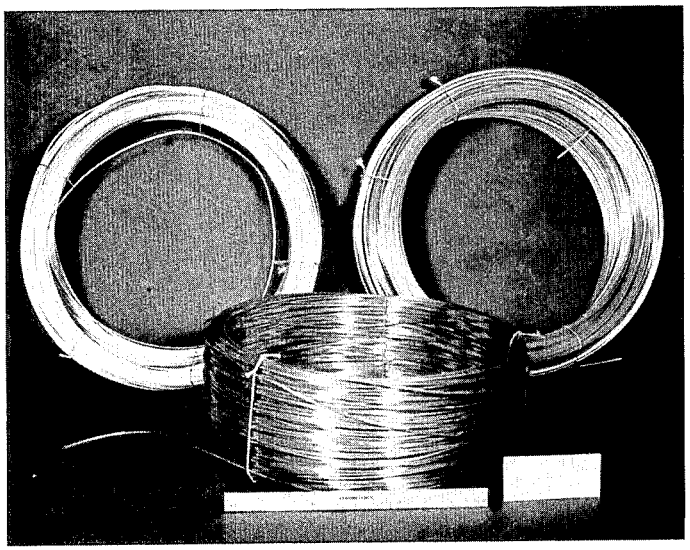

FRICTION-ACTUATED EXTRUSION OF RAPIDLY SOLIDIFIED HIGH TEMPERATURE AL-BASE ALLOYS AND PRODUCT

FIELD OF INVENTION

The present invention relates to dispersion strengthened aluminum base alloys, and more particularly to a friction-actuated extrusion process utilizing comminuted rapidly solidified powder as the in-feed for the process and forming rapidly solidified aluminum-base alloys having improved ambient and elevated temperature mechanical properties.

FRICTION-ACTUATED EXTRUSION

In a "friction-actuated" extrusion process, metal is fed into one end of a passageway formed between first and second members, with the second member having a greater surface area for engaging the metal than the first member. The passageway has an obstruction at the end remote from the end into which the metal is fed. At least one die orifice of the passageway is associated with the obstructed end. The passageway-defining surface of the second member moves relative to the passageway-defining surface of the first member in the direction towards the die orifice from the first end to the obstructed end. Frictional drag of the passageway-defining surface of the second member draws the metal through the passageway and generates therewithin a pressure that is sufficient to extrude the metal through the die orifice. The obstructed end of the passageway may be blocked substantially entirely, as described in British Patent Specification No. 1370894. In conventional practice, such as the conform process described in U.S. Pat. Nos. 4552520 and 4566303, the passageway is arcuate and the second member is a wheel with a grove formed in its surface. The first member projects into the groove and the obstructed end is defined by an abutment projecting from the first member. Preferably, the abutment member is of substantially smaller cross-section than the passageway, so that it leaves a substantial gap between the abutment member and the groove surface. In this case metal adheres to the groove surface, as described in UK Pat. No. 2069389B, whereby a portion of the metal extrudes through the clearance and remains as a lining in the groove to re-enter the passageway at the entry end, while the remainder of the metal extrudes through the die orifice.

The conform process was originally developed for the extrusion of metal rod in-feed. Attempts have been made to provide an in-feed in the form of granules. The ability to extrude aluminum and/or aluminum alloys from granular in-feed has proven to be difficult because the aluminum powder does not have adequate flow to sustain the process. This is especially true for high performance aluminum alloys such as those prepared from inert or flue gas atomization or mechanical alloying. Alloy granules produced by these processes have morphologies that render the in-feed non-flowable. In addition, the high hardness of the granules makes the actual friction-actuated extrusion difficult. To avoid flow problems associated with aluminum alloy granules having high hardness, efforts have been made to conform in-feed composed of softer aluminum and/or aluminum alloy granules. In such processes, the soft aluminum granules quickly gum the apparatus and the extruded material is prone to blistering on the surface and failing at the particle surface (i.e., interparticle separation) due to the presence of an oxide layer in the granules.

SUMMARY OF THE INVENTION

The present invention provides a process wherein rapidly solidified aluminum-base alloy granules having high hardness are conformed in a highly efficient manner.

Generally stated, in the present friction-actuated extrusion process there is used, as in-feed, a communited, rapidly solidified aluminum alloy ribbon. Gumming and flow problems are virtually eliminated. The conformed product is devoid of surface blistering and has improved ambient and elevated temperature mechanical properties.

BRIEF DESCRIPTION OF THE DRAWING

The invention will be more fully understood and further advantages will become apparent when reference is made to the following detailed description and the accompanying drawing in which the figure is a photograph depicting three coils of wire manufactured using the friction-actuated extrusion process of the invention.

DESCRIPTION OF THE PREFERRED EMBODIMENTS

The rapid solidified ribbon is the product of a melt spinning process selected from the group consisting of jet casting or planar flow casting. In such processes, which are conventional, the melt spun ribbon is produced by injecting and solidifying a liquid metal stream onto a rapidly moving substrate. The ribbon is thereby cooled by conductive cooling rates in the range of $10^5$ to $10^7$ ° C./sec. Such processes typically produce homogeneous materials, and permit control of chemical composition by providing for incorporation of strengthening dispersoids into the alloy at sizes and volume fractions unattainable by conventional ingot metallurgy. In general, the cooling rates achievable by melt spinning greatly reduce the size of the intermetallic dispersoids formed during solidification. Furthermore, engineered alloys containing substantially higher quantities of transition elements are able to be produced by rapid solidification with mechanical properties superior to those previously produced by conventional solidification processes. The rapidly solidified ribbon is subsequently pulverized to a particulate, or powder, which is used as the conform in-feed. The particulate can range in particle size from approximately one quarter of an inch (0.635 cm) in diameter to about one thousandth of an inch (0.0025 cm) in diameter. Powder produced by this method is flowable, which properly enhances the ability of the material to be successfully conformed. As used herein, the term "flowable" means free flowing and is used in reference to those physical properties of a powder, such as composition, particle fineness, and particle shape, that permit the powder to flow readily into a die cavity (see, for example, Metals Handbood, Ninth Edition, Volume 7, Powder Metallurgy, American Society for Metals, p.. 278). More specifically, to be flowable or free flowing, the powder must be able to pass through the 2.5 mm diameter orifice of a Hall flowmeter funnel, with or without an external pulse (ASTM B 213 and MPIF 3).

The aluminum base, rapidly solidified alloy has a composition consisting essentially of the formula $Al_{bal}Fe_aSi_bX_c$ wherein X is at least one element selected from the group consisting of Mn, V, Cr, Mo, W, Nb, Ta, "a" ranges from 2.0 to 7.5 at %, "b" ranges from 0.5 to 3.0 at %, "c" ranges from 0.05 to 3.5 at % and the balance is aluminum plus incidental impurities, with the proviso that the ratio [Fe+X]:Si ranges from about 2.0:1 to 5.0:1. Examples include aluminum-iron-vandium silicon alloys, wherein the iron ranges from about 1.5–8.5 at %, vanadium ranges from about 0.25–4.25 at %, and silicon ranges from about 0.5–5.5 at %.

Alternatively, the aluminum base, rapidly solidified alloy has a composition consisting essentially of the formula $Al_{bal}Fe_aSi_bX_c$ wherein X is at least one element selected from the group consisting of Mn, V, Cr, Mo, W, Nb, Ta, "a" ranges from 1.5 to 7.5 at "b" ranges from 0.75 to 9.0 at %, "c" ranges from 0.25 to 4.5 at % and the balance is aluminum plus incidental impurities, with the proviso that the ratio [Fe+X]:Si ranges from about 2.01:1 to 1.0:1.

An alternative aluminum base, rapidly solidified alloy has a composition range consisting essentially of about 2–15 at % of at least one element selected from the group consisting of zirconium, hafnium, titanium, vanadium, niobium, tantalum and erbium, about 0–5 at % calcium, about 0–5 at % germanium, about 0–2 at % boron, the balance being aluminum plus incidental impurities.

Yet another alternative low density aluminum base, rapidly solidified alloy has a composition consisting essentially of the formula $Al_{bal}Zr_aLi_bMg_cT_d$, wherein T is at least one element selected from the group consisting of Cu, Si, Sc, Ti, B, Hf, Be, Cr, Mn, Fe, Co and Ni, "a" ranges from about 0.05–0.75 at %, "b" ranges from about 9.0–17.75 at %, "c" ranges from about 0.45–8.5 at %, "d" ranges from about 0.05–13 at % and the balance being aluminum plus incidental impurities.

In use of the process of the invention as described hereinabove, it has been found that certain disadvantages, such as metal surface blistering, gumming of the equipment and the inability to friction-actuate extrude aluminum alloys with enhanced properties have been overcome. When extruding aluminum alloy from aluminum alloy powder by conventional process, the aluminum alloy powder must be vacuum degassed at some elevated temperature to remove any gases on the powder surface which may outgas during consolidation, fabrication or use and produce blistering on the metal surface.

The present process is particularly advantageous in that no degassing of the powder in-feed is required prior to friction-actuated extrusion, and the extruded product requires no outgasing.

EXAMPLE I

Thirty kilogram batches of −40 mesh (U.S. standard sieve) powder of the composition aluminum-balance, 4.33 at. % iron, 0.33 at. % Vanadium and 1.72 at. % Silicon were produced by comminuting rapidly solidified planar flow cast ribbon. The comminuted ribbon was friction-actuated extruded to approximately 3mm diameter ribbon using a conform machine of the type described in UK Pat. No. 2,069,389B. The resulting extruded wire is shown in FIG. 1. The surface of the wire is bright and shows no evidence of surface blistering. The wire is uniform and substantially void-free.

EXAMPLE II

A batch of powdered aluminum alloy conformed using the procedure set forth in Example I was processed, into wire in a conventional manner. During this conventional process, the batch was conventionally processed degassed, vacuum hot pressed into a 9 cm diameter billet and extruded at 385° C. into a rectangle 5 cm×1 cm. A 3 mm diameter wire (the gauge section of a tensile specimen) was machined from the extrusion. Tensile properties were measured on the conformed 3 mm wire processed as described in Example I and on the conventionally compacted and extruded wire. The resultant tensile properties are listed below.

| Material | Y.S. (MPa) | U.T.S. (MPA) | % El | % RA |
|---|---|---|---|---|
| Conformed Wire | 434 | 510 | 15 | 47 |
| Conventional Wire | 393 | 448 | 17 | 55 |

The Conformed wire shows a significantly greater strength than the conventionally processed wire.

EXAMPLE III

The 3mm diameter conformed wire produced in Example I was exposed at various temperatures up to 600° C. for 24 and 100 hours. Only at the highest temperature did the material show sporadic blistering. A list of the exposures and the resultant tensile properties are listed below.

| Thermal Exposure (°C./hr) | Y.S. (MPa) | U.T.S. (MPa) | % El | % RA |
|---|---|---|---|---|
| None | 434 | 510 | 15 | 47 |
| 200/24 | 476 | 528 | 15.9 | 50 |
| 300/24 | 487 | 527 | 15.6 | 51 |
| 400/24 | 494 | 530 | 15.9 | 53 |
| 400/100 | 507 | 535 | 15.6 | 52 |
| 500/24 | 473 | 512 | 13.3 | 41 |
| 500/100 | 441 | 498 | 6.7 | 18 |
| 600/24 | 152 | 271 | 7.4 | 16 |
| 600/100 | 137 | 246 | 9.4 | 11 |

EXAMPLE IV

Thirty kilogram batches of −40 mesh (U.S. standard sieve) powder of the composition aluminum-balance, 2.73 at. % iron, 0.27 at. % Vanadium and 1.05 at. % Silicon were produced by comminuting rapidly solidified planar flow cast ribbon. The comminuted ribbon was friction-actuated extruded to approximately 3 mm diameter ribbon using a conform matching of the type described in UK Pat. No. 2,069,389B. The surface of the wire is bright and shows no evidence of surface blistering. The wire is uniform and substantially void-free.

EXAMPLE V

A batch of powdered aluminum alloy conformed using the procedure set forth in Example I was processed into wire in a conventional manner. During this conventional process, the batch was conventionally processed, degassed, vacuum hot pressed into a 9 cm diameter billets and extruded at 385° C. into a rectangle 5 cm×1 cm. A 3 mm diameter wire (the gauge section of a tensile specimen) was machined from the extrusion. Tensile properties were measured on the conformed 3 mm wire processed as described in Example I and on the conventionally compacted and extruded wire. The resultant tensile properties are listed below.

| Material | Y.S. (MPa) | U.T.S. (MPA) | % EL |
|---|---|---|---|
| Conformed Wire | 361 | 510 | 24.5 |
| Conventional Wire | 310 | 352 | 16.7 |

The conformed wire shows a significantly greater strength than the conventionally processed wire.

EXAMPLE VI

The 3 mm diameter conformed wire produced in EXAMPLE I was exposed at various temperatures up to 600° C. for 24 and 100 hours. Only at the highest temperature did the material show sporadic blistering. A list of the exposures and the resultant tensile properties are listed below.

| Thermal Exposure (°C./hr) | Y.S. (MPa) | U.T.S. (MPa) | % El | % RA |
|---|---|---|---|---|
| None | 361 | 318 | 24.5 | 57 |
| 300/24 | 510 | 546 | 13.6 | 42 |
| 400/24 | 508 | 531 | 17.8 | 48 |
| 400/100 | 499 | 526 | 14 | 39 |
| 500/24 | 503 | 530 | 13.9 | 33 |
| 500/100 | 483 | 528 | 10.5 | 29.3 |
| 600/24 | 195 | 250 | 6.9 | 11 |
| 600/100 | 250 | 294 | 3 | 9 |

The effects of exposure on strength are approximately the same after both 24 and 100 hours. As the exposure temperature is increased, strength increases reaching a maximum at 400° C. After 500° C. exposure, the strength falls between the maximum value and the unexposed value, while after 600° C. exposure, the strength drops to about half the as-extruded value.

These results evidence the excellent stability of the "friction-actuated" extrusions. In addition, the results show that highly stable aluminum alloys are formed by the process of the invention without need for outgasing and hot consolidation procedures.

Having thus described the invention in rather full detail, it will be understood that such detail need not be strictly adhered to but that various changes and modifications may suggest themselves to one skilled in the art, all falling within the scope of the invention as defined by the subjoined claims.

We claim:

1. A friction-actuated extrusion process in which a continuous friction-actuated extruder has, as in-feed, a particulate that has not been outgassed, said particulate having been comminuted from rapidly solidified aluminum alloy ribbon.

2. A process as recited in claim 1, wherein said ribbon is the product of a melt spinning process selected from the group consisting of jet casting and planar flow casting.

3. A process as recited in claim 1, wherein said in-feed requires no outgasing.

4. A process as recited in claim 2, wherein said particulate has a particle size ranging from about 0.0025 to 0.635 centimeters in diameter.

5. A process as recited in claim 2, wherein said rapidly solidified aluminum based alloy has a composition consisting essentially of the formula $Al_{bal}Fe_aSi_bX_c$, wherein X is at least one element selected from the group consisting of Mn, V, Cr, Mo, W, Nb, Ta, "a" ranges from 2.0 to 7.5 at %, "b" ranges from 0.5 to 3.0 at %, "c" ranges from 0.05 to 3.5 at % and the balance is aluminum plus incidental impurities, with the proviso that the ratio [Fe+X]:Si ranges from about 2.0 1 to 5.0:1 .

6. A process as recited in claim 5, wherein said rapidly solidified aluminum based alloy consists essentially of about 1.5–8.5 at % iron, about 0.25–4.25 at % vanadium, and about 0.5–5.5 at % silicon, the balance being aluminum plus incidental impurities.

7. A process as recited in claim 2, wherein said rapidly solidified aluminum based alloy has a composition consisting essentially of the formula $Al_{bal}Fe_aSi_bX_c$, wherein X is at least one element selected from the group consisting of Mn, V, Cr, Mo, W, Nb, Ta, "a" ranges from 1.5 to 7.5 at %, "b" ranges from 0.75 to 9.0 at %, "c" ranges from 0.25 to 4.5 at % and the balance is aluminum plus incidental impurities, with the proviso that the ratio [Fe+X]:Si ranges from about 2.01:1 to 1.0:1.

8. A process as recited in claim 2, wherein said rapidly solidified aluminum based alloy has a composition consisting essentially of about 2–15 at % of at least one element selected from the group consisting of zirconium, hafnium, titanium, vanadium, niobium, tantalum and erbium, about 0–5 at % calcium, about 0–5 at % bermanium, about 0–2 at % boron, the balance being aluminum plus incidental impurities.

9. A process as recited in claim 2, wherein said rapidly solidified aluminum based alloy has a composition consisting essentially of the formula $Al_{bal}Zr_aLi_bMg_cT_d$, wherein T is at least one element selected from the group consisting of Cu, Si, Sc, Ti, B, Hf, Be, Cr, Mn, Fe, Co and Ni, "a" ranges from about 0.05–0.75 at %, "b" ranges from about 9.0–17.75 at "c" ranges from about 0.45–8.5 at %, "d" ranges from about 0.05–13 at % and the balance is aluminum plus incidental impurities.

10. A friction-actuated extrusion produced by the process of claim 1, said extrusion being a consolidated, mechanical formable, substantially void free mass.

11. A friction-actuated extrusion as recited in claim 6.

12. A friction-actuated extrusion as recited in claim 6, having the shape of a wire or tube.

13. A friction-actuated extrusion as recited in claim 6, having mechanical properties at least equivalent to conventionally processed material.

14. A process as recited in claim 4, wherein the particulate is flowable.

* * * * *

UNITED STATES PATENT AND TRADEMARK OFFICE

CERTIFICATE OF CORRECTION

PATENT NO. : 4,898,612

DATED : Feb. 6, 1990

INVENTOR(S) : P.S. Gilman et al.

It is certified that error appears in the above-identified patent and that said Letters Patent is hereby corrected as shown below:

Col. 3, line 14: "1.5 to 7.5 at" should read -- 1.5 to 7.5 at %, --.

Col. 6, line 45: "9.0-17.75 at" should read -- 9.0-17.75 at %, --.

Signed and Sealed this

Twenty-fifth Day of June, 1991

*Attest:*

*Attesting Officer*

HARRY F. MANBECK, JR.

*Commissioner of Patents and Trademarks*